United States Patent [19]

Kamp et al.

[11] Patent Number: 4,485,879

[45] Date of Patent: Dec. 4, 1984

[54] DOWNHOLE MOTOR AND METHOD FOR DIRECTIONAL DRILLING OF BOREHOLES

[75] Inventors: Anthony W. Kamp; Robijn Feenstra, both of Rijswijk, Netherlands

[73] Assignee: Shell Oil Company, Houston, Tex.

[21] Appl. No.: 518,270

[22] Filed: Jul. 28, 1983

[30] Foreign Application Priority Data

Aug. 25, 1982 [GB] United Kingdom ..... 8224338

[51] Int. Cl.[3] ..... E21B 7/04

[52] U.S. Cl. ..... 175/61; 175/107; 175/320

[58] Field of Search ..... 175/61, 107, 92, 320, 175/95

[56] References Cited

U.S. PATENT DOCUMENTS 4,143,722 3/1979 Driver ..... 175/61 X 4,267,893 5/1981 Mannon ..... 175/107 X

FOREIGN PATENT DOCUMENTS 294923 10/1971 U.S.S.R. ..... 175/61

625430 11/1979 U.S.S.R. ..... 175/107

*Primary Examiner*—Stephen J. Novosad

*Assistant Examiner*—Michael Starinsky

[57] ABSTRACT

The invention relates to a downhole motor having a housing of which the resistance against bending in a predetermined longitudinal plane is smaller than in any other longitudinal plane. Directional drilling of boreholes is carried out by rotating the drill string simultaneously with the rotation of the drill bit driven by the downhole motor over periods preceded and followed by selected periods during which the drill string is not rotated simultaneously with the rotation of the drill bit driven by the downhole motor.

2 Claims, 7 Drawing Figures

FIG. 1
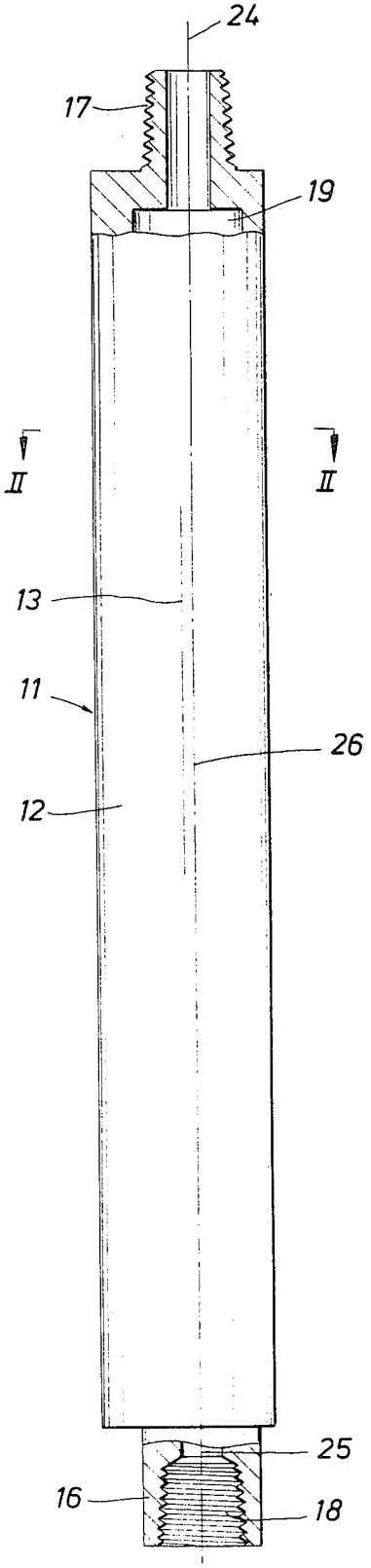
FIG. 2
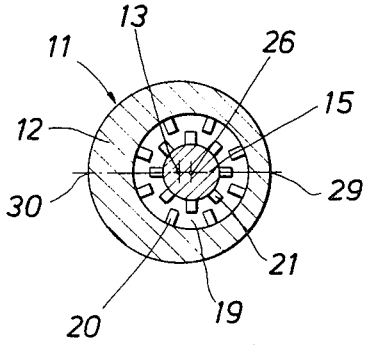
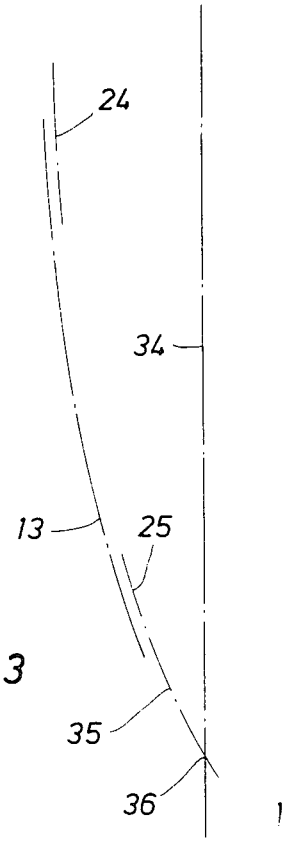
FIG. 3

DOWNHOLE MOTOR AND METHOD FOR DIRECTIONAL DRILLING OF BOREHOLES

BACKGROUND OF THE INVENTION

The invention relates to drilling of boreholes in underground formations in search for valuable materials such as hydrocarbons. More in particular, the invention relates to a downhole motor and a method for directional drilling of such boreholes.

The expression "directional drilling of a borehole" is used in the specification and in the claims to refer to drilling of a borehole of which the direction is caused to depart at will from the vertical or from any other direction.

A means known in the art for directional drilling is a "variable bent sub". The variable bent sub is a pipe section interconnecting the lower end of a drill string and the upper end of a downhole motor which is used to drive a drill bit during drilling of a borehole. The pipe section includes a flexible joint and a remotely controlled servo-mechanism for adjusting the deflection of the flexible joint. When during drilling, if the borehole should depart from its original direction, the drill string is rotated over a finite amount to orient the pipe section in the desired direction and thereafter the servo-mechanism actuated, thereby causing the sub to deflect. On further drilling, the bent sub is maintained in the best position and a curved borehole section is drilled. This curved borehole section departs from the original direction in a predetermined direction, to wit the direction of the plane in which the variable best sub in bent. When the desired inclination of the section has been reached, the sub is stretched and a straight borehole section is thereupon drilled in a direction that is at an angle to the original direction of the hole. If desired, this straight section can again be followed by a curved section by actuating the servo-mechanism.

The variable bent sub is described in detail in U.S. Pat. No. 3,713,500 (issued: Jan. 30, 1973; inventor: Russell, M. K.).

A major disadvantage of the bent sub resides in the complexity of the servo-mechanism which is included in the pipe section for adjusting the deflection of the pipe section.

SUMMARY OF THE INVENTION

The object of the invention is a simple and reliable downhole motor and a method for directional drilling by means of this motor.

According to the invention, the downhole motor includes a housing with a central axis, the housing optionally carrying at least one stabilizer and being provided with a longitudinal passage and with upper connector means for connecting the motor to the lower end of a drill string, wherein the motor further includes an output shaft with lower connector means for connecting a drill bit to the output shaft, characterized in that the cross-section of the housing is selected such that the resistance against bending under axial compressive load exerted on the housing is smaller in a single longitudinal plane passing through the central axis of the housing than in any other longitudinal plane.

In the specification this single longitudinal plane will be referred to as "predetermined plane of bending".

The method for directional drilling of boreholes in subsurface formation drilled with the downhole motor according to the invention comprises the steps of:

(a) connecting a drill bit to the output shaft of a downhole motor and lowering the downhole motor/-drill bit assembly in the borehole at the end of a drill string;

(b) actuating the downhole motor to rotate the drill bit and applying a predetermined weight on bit; and (c) simultaneously with step (b) rotating the drill string over periods that are preceded and followed by slected periods during which the drill string is not rotated.

Applying a predetermined weight on bit causes the downhole motor according to the invention to bend in its predetermined plane of bending. As will be described when the method for directional drilling according to the invention is disclosed, a straight borehole section is drilled when the drill string is rotated simultaneously with the rotation of the drill bit driven by the downhole motor. When it is desired to depart from this straight section, the rotation of the drill string is stopped, and on further drilling with the downhole motor driving the drill bit a curved borehole section is drilled of which the direction coincides with the direction of the predetermined plane of bending of the downhole motor. Thus, directional drilling is carried out by selectively rotating and not rotating the drill string.

BRIEF DESCRIPTION OF THE DRAWING

The invention will now be described by way of example in more detail with reference to the drawings, wherein;

FIG. 1 schematically shows a side view of a downhole motor according to the invention provided with a circle cylindrical housing wherein the longitudinal passage is located eccentrically with respect to the central axis of the housing;

FIG. 2 shows a cross-section of FIG. 1 over the line II—II;

FIG. 3 schematically above the positions of the imaginary central axes of the housing, the upper connector means and the lower connector means of the downhole motor according to FIGS. 1 and 2 relative to the position of the imaginary central axis of a borehole, when the down motor is located in the borehole and subjected to drilling conditions so as to be subjected to drilling conditions so as to be bent in the predetermined plane of bending;

DESCRIPTION OF A PREFERRED EMBODIMENT

Figure 4:
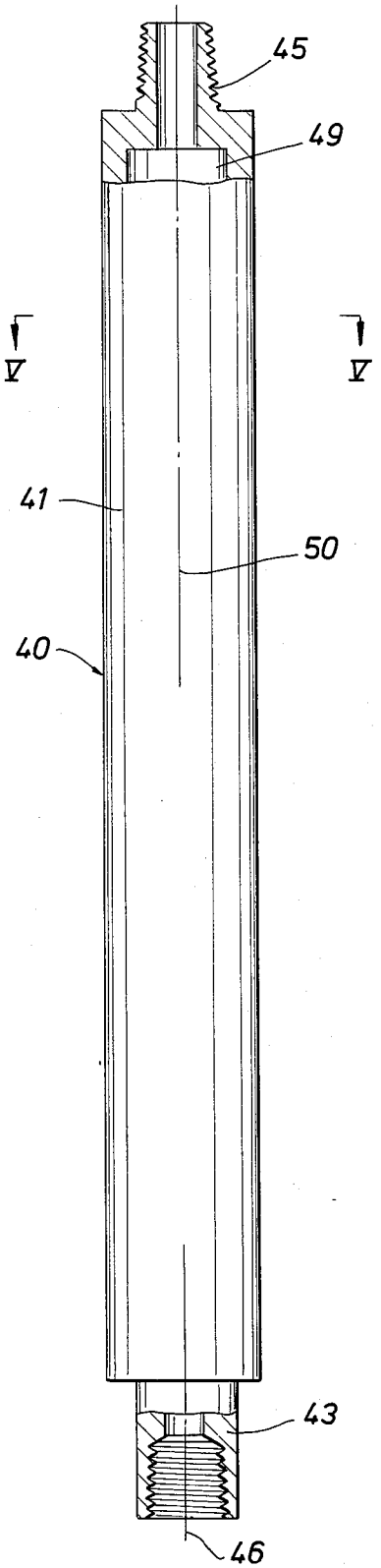
FIG. 4 schematically shows a side view of a downhole motor according to the invention provided with a housing having an elliptically shaped cross-section.

Reference is now made to FIG. 1 showing a side view of a downhole motor according to the invention provided with a circle cylindrical housing having a longitudinal passage located eccentrically in the housing, and to FIG. 2 showing a cross-section of FIG. 1 over the line II—II. The downhole motor is a hydraulic turbine, generally represented by numeral 11, designed to be driven by fluid passing under pressure therethrough. The turbine 11 includes a housing 12 with a central axis 13, a rotor 15, and an output shaft 16 connected to the rotor 15. The housing 12 is provided with upper connector means 17 in the form of a pin thread for connecting the turbine 11 to the lower end of a drill string (not shown), and the output shaft 16 is provided with lower connector means 18 in the form of a box thread for connecting a drill bit (not shown) to the output shaft 16 in a manner well known to the art.

The housing 12 is further provided with a longitudinal passage 19, the wall thereof carrying stator blades 20. The stator blades 20 are arranged to co-operate with the rotor blades 21 mounted on the rotor 15 in such a way that drilling fluid passing through the longitudinal passage 19 will rotate the rotor 15 in a manner well known to the art.

Further details of the hydraulic turbine (such as the bearings supporting the rotor) have not been shown, as such details are known per se.

The central axes 24 and 25 of the upper and lower connector means 17 and 18, respectively, coincide with the central axis 26 of the longitudinal passage 19. As the longitudinal passage 19 is arranged eccentrically in the housing 12, the axes 24, 25 and 26 are located parallel to the central axis 13 of the housing 12 at a radially-offset position thereto.

As the central axis 26 of the longitudinal passage 19 is parallel to the central axis 13 of the housing 12, side 29 of the housing is of smaller thickness than the opposite side 30 of the housing (FIG. 2.).

When the turbine 11 is loaded with axial-compressive forces acting on the upper connector means 17 and on the lower connector means 18 (as will occur during drilling of a borehole when weight is applied on bit), the turbine will bend in the predetermined plane of bending which is the plane passing through both the central axis 13 of the housing 12 and the central axis 26 of the longitudinal passage 19, as the resistance against bending in this plane is smaller than the resistance against bending in any other longitudinal plane.

The way in which the turbine according to the invention is to be operated for directional drilling of boreholes will now be described.

When the turbine is used to drill a further section of an already existing borehole, a drill bit is connected to the output shaft of the turbine and the turbine is connected to the lower end of a drill string. Subsequently, the turbine/drill bit assembly is lowered in the borehole. When the drill bit is in contact with the bottom of the borehole, drilling fluid is pumped through the interior of the drill string to actuate the turbine and the bit attached thereto while a predetermined amount of weight is applied on bit. As a result thereof the drill bit penetrates the formation as a borehole section is being drilled.

When a selected weight above a predetermined value is applied on bit the turbine will bend, and, as described with reference to FIG. 1, the bending will take place in the predetermined plane of bending of the turbine.

To drill a straight section of a borehole, the drill string is rotated simultaneously with the rotation of the turbine driven drill bit. However, when it is desired to drill a curved section, the drill string is not rotated but the bit is actuated solely by the action of the turbine. Thus, by selectively rotating and not rotating the drill string a borehole can be drilled having alternately curved and straight borehole sections.

The drill string is rotated by actuating the rotary table located in the drilling rig from which the drill string is suspended. As the operation of such a rig is known per se, no details thereof are described.

In more detail, directional drilling with the turbine according to the invention will be described with reference to FIG. 3, showing the imaginary positions of the central axis 34 of a straight, vertical borehole, the central axis 13 of the housing, the central axis 24 of the upper connector means and the central axis 25 of the lower connector means of the turbine of FIG. 1 when the turbine is in its operative position in the borehole. FIG. 3 also shows the position of the central axis 35 of a drill bit connected to the output shaft of the turbine. In its operative position the turbine is bent when a selected weight on bit is applied, and the bending takes place in the predetermined plane of bending, which plane coincides with the plane of drawing of FIG. 3. The side 30 (see FIG. 2) of the turbine is partly supported by the borehole wall when in the weight-loaded drilling mode, and the centre 36 of the drill bit is located on the central axis 34 of the borehole.

For a ready understanding of FIG. 3, the curvature of the central axis 13 of the housing as well as the inclinations of the central axes 13, 24, 25, and 35 with respect to the central axis 34 of the borehole have been exaggerated.

For drilling a straight section forming an extension of the borehole, the turbine is actuated to drive the drill bit and, simultaneously therewith, the drill string is also rotated. By rotating the drill string the bent turbine is rotated about the central axis 34 of the borehole, and when drilling continues and the bit penetrates the formation the part of the side 30 of the turbine that is in contact with the borehole wall will describe a helical path along the wall, thus guiding the centre 36 of the drill bit along the extension of th central axis 34 of the borehole. Consequently a borehole section, of a diameter greater than that of the drill bit, is drilled of which the central axis is in direct line with the central axis 34 which results in a vertical and straight borehole section.

For drilling a curved extension of the borehole the turbine is actuated to rotate the drill bit but the drill string is not rotated. The drill bit then drills in the inclined direction of the central axis 35 of the drill bit. Further drilling in this inclined direction forces the turbine to bend in such a way that its curvature increases. Consequently there is an increase in the inclination of the central axis 35 of the drill bit and the inclination of the borehole section that is being drilled. Thus, an increase in the inclination of the borehole section results in an increase in the inclination of the central axis 35 of the drill bit which on further drilling results in a further increase in the inclination of the borehole section. Consequently a curbed borehole section is drilled of which the inclination increases with depth. When the desired inclination of the borehole section is reached, rotation of the drill stiring is resumed and on further drilling the curvature of the borehole gradually decreases and a straight and inclined borehole section is drilled.

If desired, drilling of such a straight section can be followed by drilling another curved section in the manner as described hereinabove. Thus the turbine according to the invention allows directional drilling of a borehole by rotating the drill bit in order to extend the borehole, and simultaneously therewith rotating the drill string over selected periods that are preceded and followed by periods during which the drill string is not rotated.

The direction in which the curved sections of the borehole are being drilled can be monitored by surveying equipment that is carried by the lower end of the drill string. Such equipment is applied for measuring inclination and direction of the borehole and in addition thereto the direction of the predermined plane of bending of the turbine. As this surveying equipment is known per se no details of such systems will be described.

When it is required to change the direction of the borehole section, the direction of the predetermined plane of bending is changed by the desired amount by adjusting the angular position of the drill string by selectively rotating the rotary table.

Figure 5:
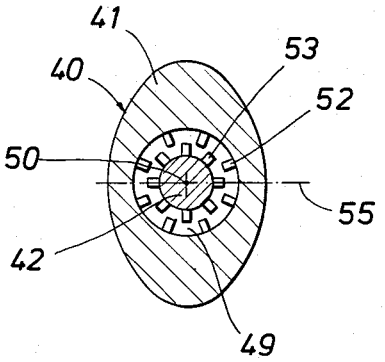
FIG. 5 shows a cross-section of FIG. 4 over the line V—V.

An alternative embodiment of the downhole motor according to the invention will now be described with reference to FIG. 4 showing a side view of a downhole motor provided with a housing having an elliptically shaped cross-section, and to FIG. 5 showing a cross-section of FIG. 4 over the line V—V. The downhole motor is a hydraulically driven turbine 40 provided with a housing 41 having a cylindrical outer surface of which a cross-section is an ellipse. The turbine 40 is further provided with a rotor 42 and an output shaft 43 which is connected to the rotor 42.

The housing 41 is provided with upper connector means 45 for connecting the turbine 40 to the lower end of a drill string (not shown) and the output shaft 43 is provided with lower connector means 46 for connecting a drill bit (not shown) to the output shaft 43. The housing is further provided with a central longitudinal passage 49.

The central axes of the upper connector means 45, the output shaft 43 and the central longitudinal passage 49 coincide with the central axis 50 of the housing 41.

Part of the wall of central longitudinal passage 49 carries stator blades 52 which are arranged to co-operate with rotor blades 53 mounted on the rotor 42 in such a way that drilling fluid passing through the central longitudinal passage 49 will rotate the rotor 42.

Further details of the hydraulic turbine (such as the bearings supporting the rotor) have not been shown, as such details as known per se.

When the turbine 40 is loaded with selected axial compressive forces acting on the upper connector means 45 and on the lower connector means 46 the turbine will bend in the longitudinal plane passing through the minor axis 55 of the elliptically shaped cross-section of the turbine housing 41, since the resistance against bending in this plane is smaller than the resistance against bending in any other longitudinal plane passing through the central axis 50 of the housing. The longitudinal plane passing through the minor axis 55 of the elliptically shaped cross-section of the turbine housing 41 is referred to as the predetermined plane of bending, and it will be appreciated that this predetermined plane of bending is parallel to the plane of drawing of FIG. 4.

The method for directional drilling of boreholes in subsurface formations with the turbine having a housing with an elliptically shaped cross-section as described with reference to FIGS. 4 and 5 is similar to the method for directional drilling as described with reference to FIG. 3.

The invention is not restricted to a turbine provided with a housing having an elliptically shaped cross-section as described with reference to FIGS. 4 and 5. Examples of other cross-sections selected in such a way that the resistance against bending, under axial compressive load exerted on the housing, is smaller in a predetermined longitudinal plane of bending than in any other longitudinal plane will now be described with reference to FIGS. 6 and 7.

Figure 6:
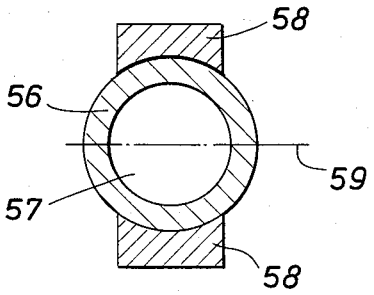
FIG. 6 schematically shows a cross-section of another form of a downhole motor housing which is provided with reinforcement ribs.

FIG. 6 shows a cross-section of a circle cylindrical housing 56 with a central longitudinal passage 57. The housing is provided with two reinforcement ribs 58 extending in axial direction along the outer surface of the housing 56. The ribs 58 are attached to the housing 56 thoughout a major length thereof by suitable means, such as welds. When axial forces are exerted on a turbine provided with a housing as described with reference to FIG. 6, the turbine will bend in a predetermined plane, to wit the longitudinal plane of the housing passing through the axis 59 of the cross-section.

Figure 7:
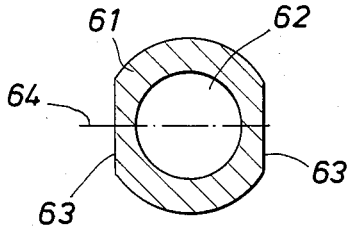
FIG. 7 schematically shows a cross-section of another form of a downhole motor housing which is provided with two flat sides.

Instead of welding reinforcement ribs to the outer surface of a cylindrical housing as shown in FIG. 6, a circle cylindrical housing may be machined to become a housing in the manner as shown in FIG. 7.

FIG. 7 shows a cross-section of a housing 61 provided with a central longitudinal passage 62 and with two flat sides 63. When a turbine having a housing with a cross-section of this kind is axially loaded with compressive forces, the turbine will bend in the predetermined plane of bending which is the plane through the longitudinal axis of the housing and the axis 64.

The method for directional drilling of boreholes in subsurface formations with a turbine having a housing as described with reference to FIGS. 6 and 7 is similar to the method for directional drilling as described with reference to FIG. 3.

The invention is not restricted to turbines that are not provided with stabilizers. If desired a plurality of stabilizers may be mounted on the housing of the turbine.

The stabilizers may be mounted eccentrically or concentrically on the housing. However, if a stabilizer is mounted eccentrically on the housing the eccentricity of the stabilizer should be located in the predetermined plane of bending.

It will appreciated that, when a plurality of stabilizers is mounted on the turbine housing the diameters of the stabilizers, the eccentricities thereof and the position of the stabilizers along the housing should be selected in relation with the diameter of the drill bit such that at least the lower part of the turbine will bend during drilling in a shape similar to the shape of the turbine as described with reference to FIG. 3.

When drilling in hard formations it may be desirable to apply wear resistant inserts on the outer surfaces of the blades of the stabilizers to reduce the wear of the stabilizers.

The invention has been described with reference to downhole motors of the hydraulic turbine type. However, the invention is not restricted to such downhole motors. If desired, downhole motors of other types known in the art may be used such as vane motors or electric motors that can be designed with a predetermined plane of bending, than in any other longitudinal plane passing through the central axis of the housing. Moreover, the downhole motors according to the invention are not restricted to those types having a circle cylindrical longitudinal passage. Downhole motors with a helically shaped longitudinal passage. Downhole motors with a helically shaped longitudinal passage (such as the Moineau- or Mono-motor) may also be applied.

We claim as our invention:

1. Method for directional drilling of boreholes in subsurface formations, by means of a downhole motor connected into a drill string near the lower end thereof, said method comprising the steps of:

(a) connecting a drill bit to the output shaft of a downhole motor and lowering the downhole motor/drill bit assembly in the borehole at the end of a drill string, (b) actuating the downhole motor to rotate the drill bit and applying a predetermined weight on bit, said weight being an amount sufficient to cause the normally-straight axis of the downhole motor to be curved along its longitudinal length, and (c) simultaneously with step (b) rotating the drill string over periods that are preceded and followed by selected periods during which the drill string is not rotated.

2. The method of claim 1 including the step of selectively varying the weight applied to the bit so as to vary the predetermined plane of bending of said downhole motor as desired.

* * * * *